US005787278A

United States Patent [19]

Barton et al.

[11] Patent Number: 5,787,278

[45] Date of Patent: Jul. 28, 1998

[54] METHOD AND SYSTEM FOR GENERATING AND MAILING A SYSTEM PERFORMANCE REPORT, UTILIZING A REPORT TEMPLATE WITH PREDETERMINED CONTROL COMMANDS FOR CONTROLLING THE PRINTER

[75] Inventors: Maya Barton, Chapel Hill, N.C.; James L. Harman, Southport, Conn.; Gary S. Jacobson, Norwalk, Conn.; Stephen Tymoszuk, Stratford, Conn.; Eric L. Zuidema, Norwalk, Conn.

[73] Assignee: Pitney Bowes Inc., Stamford, Conn.

[21] Appl. No.: 365,727

[22] Filed: Dec. 28, 1994

[51] Int. Cl.[6] ..... B07C 3/00

[52] U.S. Cl. ..... 395/601; 1/464.16; 1/464.17

[58] Field of Search ..... 395/100, 600, 395/776–779, 117, 149, 780, 784; 358/407, 441; 364/464.02, 519, 523; 379/100, 106; 355/14

[56] References Cited

U.S. PATENT DOCUMENTS

| | | | |
|---|---|---|---|
| 4,639,873 | 1/1987 | Baggarly | 364/464.16 |
| 5,077,582 | 12/1991 | Kravette | 399/8 |
| 5,119,306 | 6/1992 | Metelits | 364/464.16 |
| 5,200,903 | 4/1993 | Gilham | 364/464.18 |
| 5,337,258 | 8/1994 | Dennis | 364/551.01 |
| 5,518,574 | 5/1996 | Yates | 156/356 |

OTHER PUBLICATIONS

Market Manager Plus (Dow Jones, 1987, pp. 1–4).

MicroSoft Press Computer Dictionary (1993 p. 257).

*Primary Examiner*—Thomas G. Black
*Assistant Examiner*—Diane Mizrahi
*Attorney, Agent, or Firm*—Robert E. Meyer; Melvin J. Scolnick; David E. Pitchenik

[57] ABSTRACT

A report generation system and method for generating a report at predetermined timed intervals is described. In accordance with the teachings of this invention, system usage data is read from a memory device. A report template file controls print control commands which identifies the system usage data which should be printed in a report along with the report format characteristics. The formatted report is then inserted into an envelope, ready to be mailed by the user. The present invention further includes a system and method for identifying a current version of software installed in a mailing system.

14 Claims, 4 Drawing Sheets

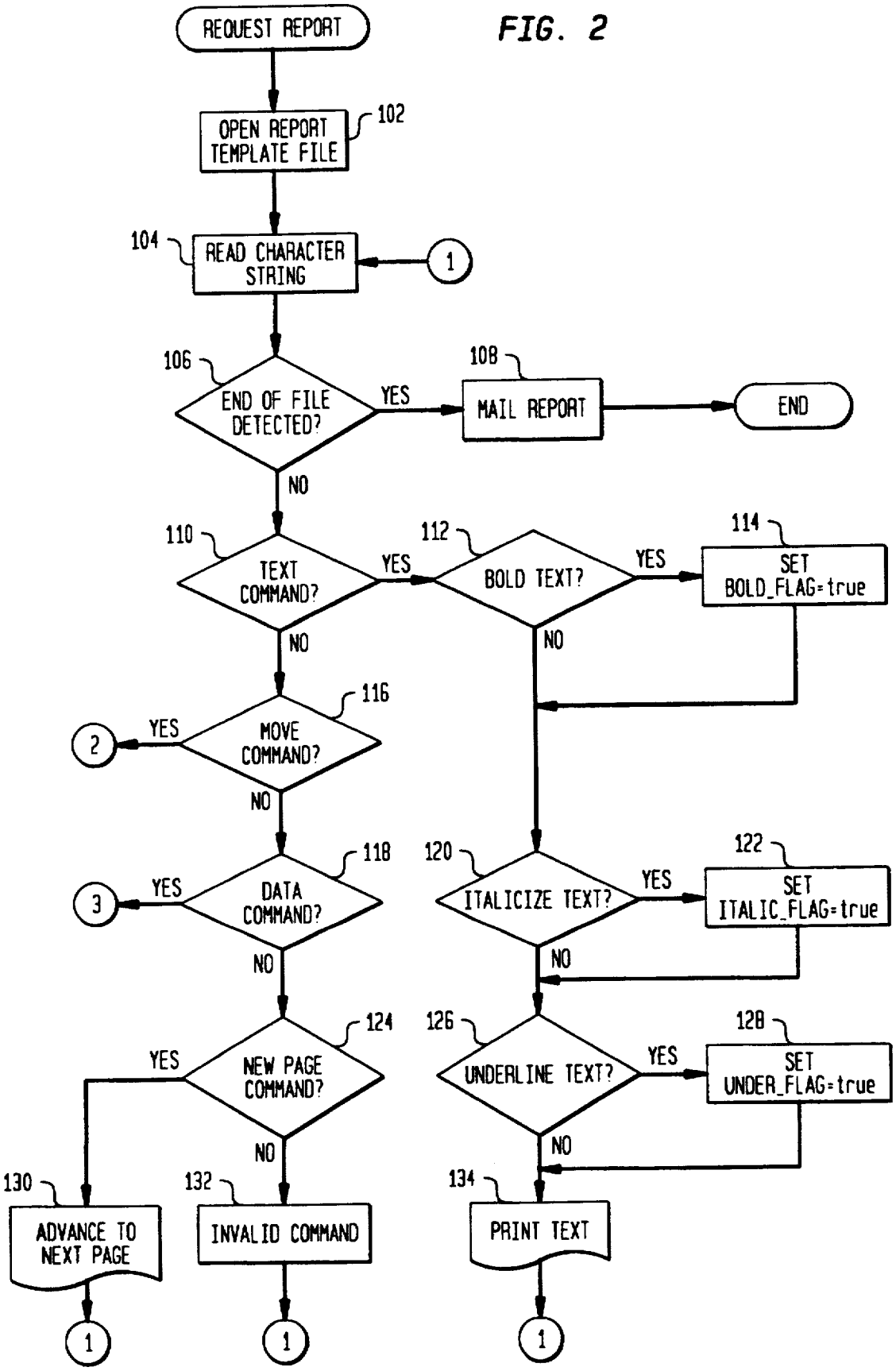
FIG. 2
REQUEST REPORT
OPEN REPORT TEMPLATE FILE
102
READ CHARACTER STRING
104
1
END OF FILE DETECTED?
106
YES
MAIL REPORT
108
END
NO
TEXT COMMAND?
110
YES
BOLD TEXT?
112
YES
SET BOLD_FLAG=true
114
NO
NO
MOVE COMMAND?
116
YES
2
NO
DATA COMMAND?
118
YES
3
NO
ITALICIZE TEXT?
120
YES
SET ITALIC_FLAG=true
122
NO
NEW PAGE COMMAND?
124
YES
NO
UNDERLINE TEXT?
126
YES
SET UNDER_FLAG=true
128
NO
ADVANCE TO NEXT PAGE
130
INVALID COMMAND
132
PRINT TEXT
134
1
1
1

METHOD AND SYSTEM FOR GENERATING AND MAILING A SYSTEM PERFORMANCE REPORT, UTILIZING A REPORT TEMPLATE WITH PREDETERMINED CONTROL COMMANDS FOR CONTROLLING THE PRINTER

BACKGROUND OF THE INVENTION

The subject invention relates to a method and system for generating a report for mailing.

In a mailing machine, it is a highly desirable feature to track the performance of a machine once it has been installed at a customer site. Such information can provide insight into the number of times a jam occurred or a component failed. Marketing representatives can then evaluate this information to develop a new product line or create enhancements to an existing product line in order to maximize the usage and minimize the cost of the product and related servicing and maintenance costs. In a similar manner, service representatives can evaluate the information to identify recurring problems with a particular type of job, material, or component.

It is also desirable to track the current version of software installed in the mailing machine. The software may be changed from time to time in order to add a special function or correct problems. This means that if the software changes many times after mass-production of the original mailing machine, various versions of the software can exist in the market. This can make it difficult for a service representative to carry out the maintenance operation of the mailing machine.

In order to evaluate the performance of a mailing machine prior to undertaking scheduled or unscheduled maintenance, a service representative must visit the customer site, identify the current system configuration installed at the customer site, then retrieve the product usage data. Because the service representative does not know the fall extent of problems experienced within the system since the last service visit, a long time is required for troubleshooting performance problems, thereby presenting a further problem of low operating efficiency.

SUMMARY OF THE INVENTION

It is therefore an object of the present invention to provide a system for generating a report for mailing which enables a service representative to view system usage data without visiting the customer site. In order to achieve the above object, the system for generating a report to be mailed is characterized by including:

a printer;

memory means for storing system data;

a plurality of report templates;

means for selecting one of the plurality of report templates, the report template containing predetermined control commands for controlling output to the printer;

means for retrieving system data from the memory means;

a microprocessor connected to the printer, the memory means, the selecting means, and the retrieving means, the microprocessor being programmed to:

read a control, command stored in the report template;

perform an operation indicated by the control command;

cause the printer to print a report, the report reflecting information defined by the report template and stored in the memory means;

means for inserting the report into an envelope; and means for placing a delivery address on the envelope.

BRIEF DESCRIPTION OF THE DRAWINGS

These and other objects and advantages of the present invention will become apparent: from the following description of the accompanying drawings. It is to, be understood that the drawings are to be used for the purpose of illustration only, and not as a definition of the invention.

In the drawings:

FIGS. 2–4 are flow diagrams detailing operation of the report generation software.

DESCRIPTION OF THE PREFERRED EMBODIMENT

Figure 1:
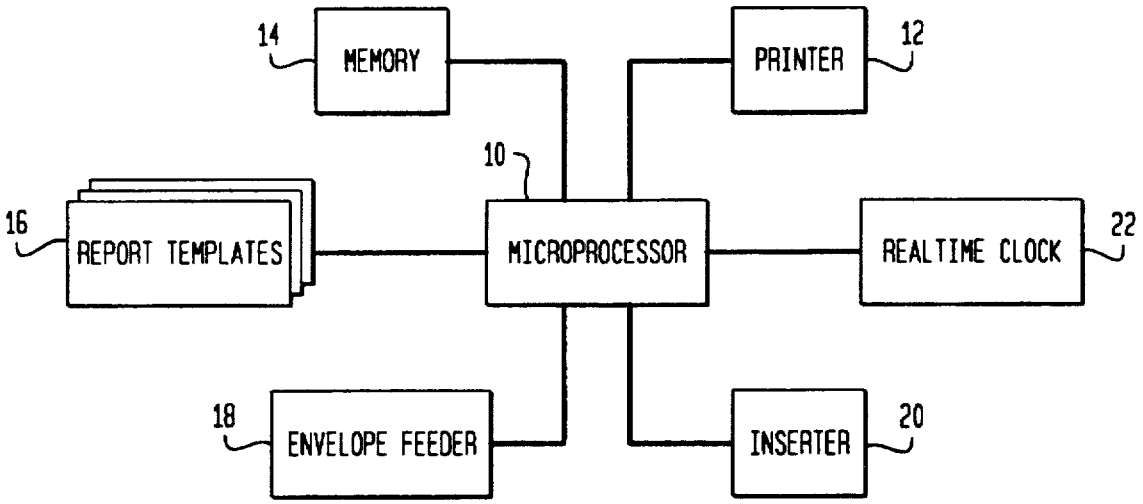
FIG. 1 is a block diagram showing an arrangement of essential components for the report generation system.
Figure 3:
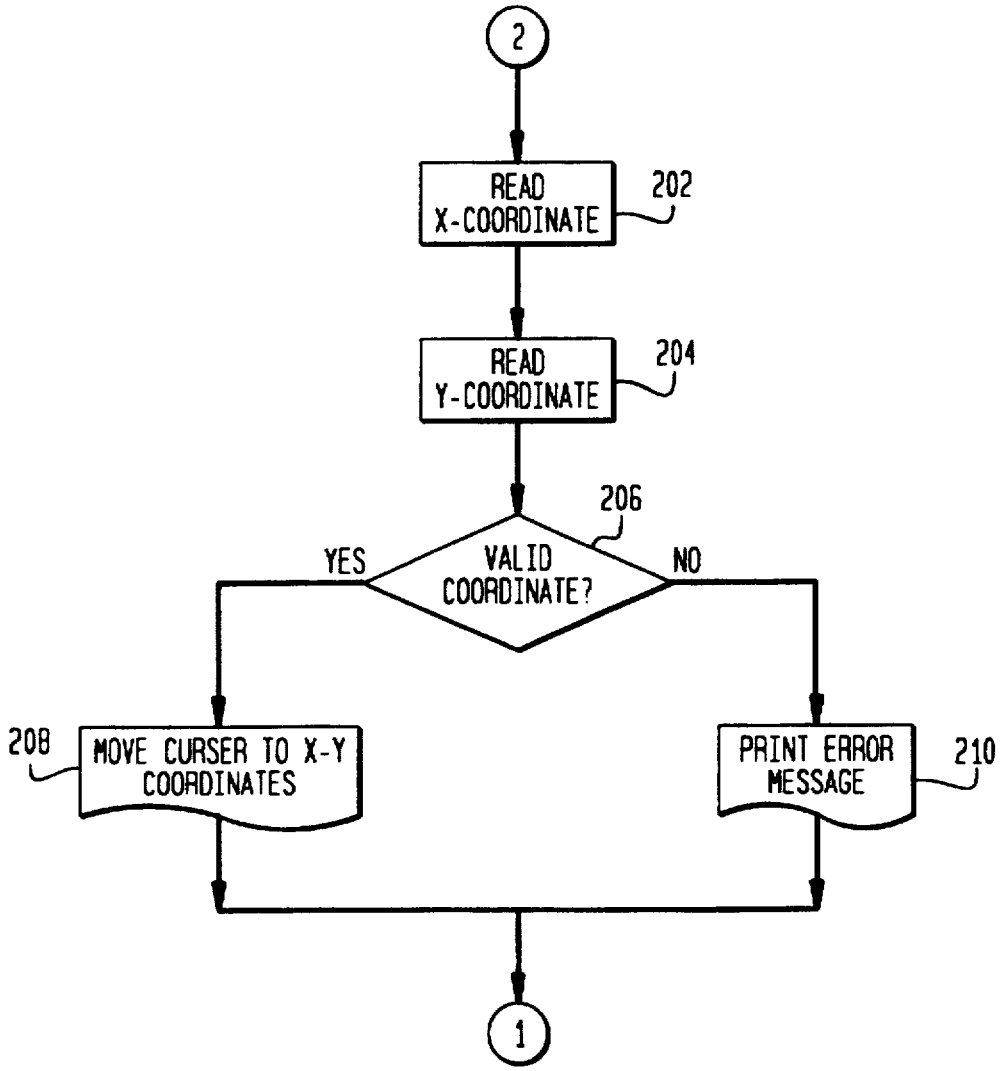
Figure 4:
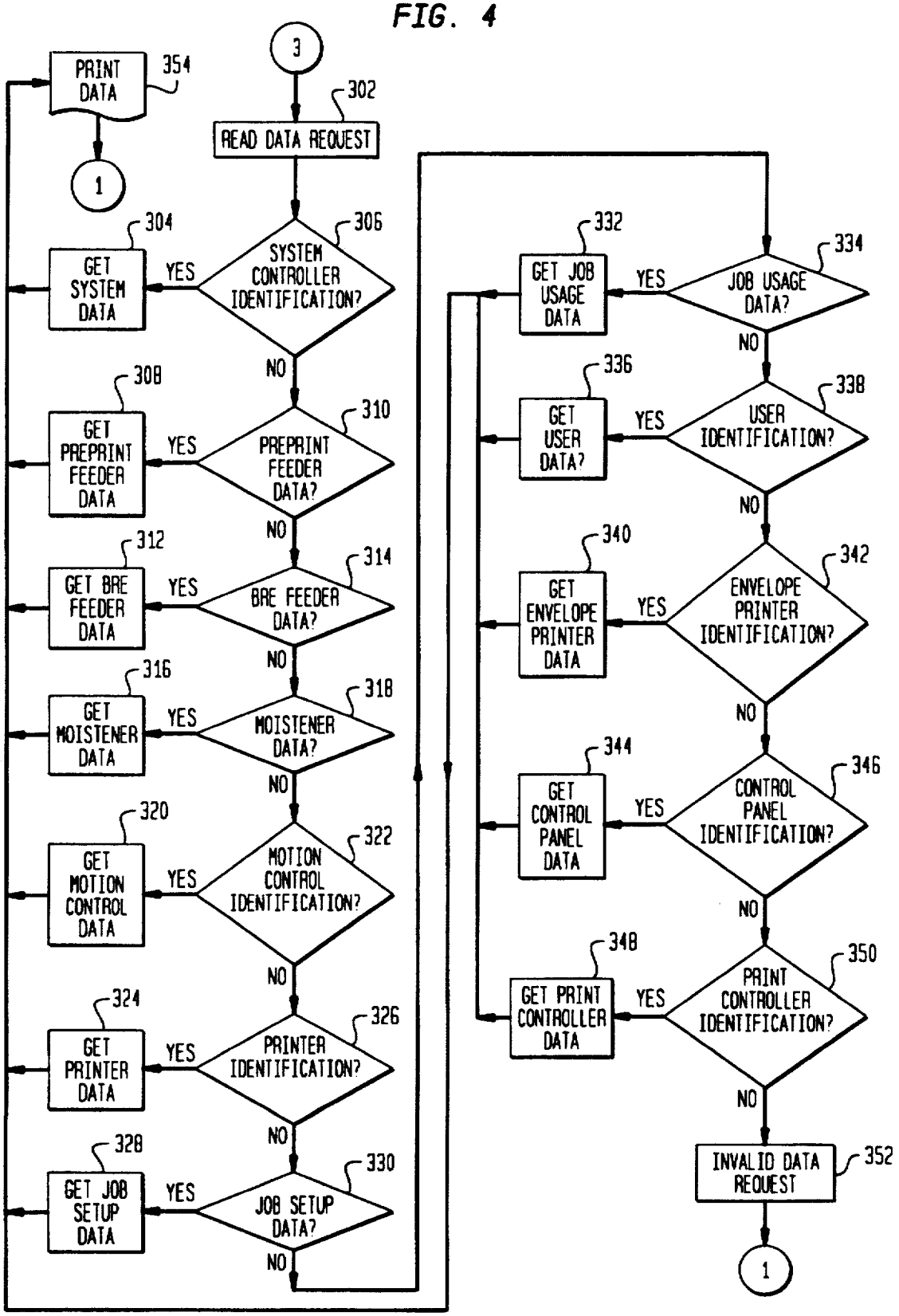

Referring to FIG. 1, the components in the report generation system include a microprocessor 10 and a real-time clock 22. Current day and time information are provided to microprocessor 10 by clock 22. Display 24 interacts with microprocessor 10. The combination provide a means for interfacing with a user of the mailing system. Printer 12 interacts with microprocessor 10 and generates a formatted report. System usage data and system identification data which may be included in the report are stored in memory 14. Once a report is printed, the envelope feeder 18 interacts with microprocessor 10 to supply an envelope for mailing the report. The inserter 20 interacts with microprocessor 10 to insert the report into the envelope.

Report templates 16 interact with the microprocessor 10 and contain print control commands for generating a formatted report. There are at least four commands that are found in report templates 16 and used to produce a report. These are MOVE, TEXT, DATA, and NEW. The function and explanation of usage for each command is summarized under their respective headings below.

A. MOVE

The MOVE command sets the printing cursor to the specified position on the page. This command takes in two values. First, is the x-coordinate, or horizontal cursor positioning of the printer 12. The second value is the y-coordinate, or vertical cursor position. The x and y-coordinates are specified in columns and rows, respectively. The x-coordinate, or column, has a range from 0 to 79. Values in the report template 16 will be tested for the validity of them being numbers, opposed to being words or other errors. If an error, or a non-number is encountered, an error message and the line in the report template 16 where it occurred will be printed at the end of the report.

B. TEXT

The TEXT command is set after a MOVE command. It prints out the specified field names for the reports. This command accepts two fields. The first field specifies any of the three special font selections for the printing of the text. They are bold, italics, and underline. They are represented by the first letter in each word, i.e., "b", "i" and "u". Letters aside from "b", "i", or "u" will be ignored. The second field is the actual text to be printed in the report.

C. DATA

The DATA command is entered after a MOVE command. This command represents the acronym for each of the field names that are currently supported. It does the job of calling and pulling, from memory 14, the required information for each field name. Any unrecognized acronyms will prompt an error message at the end of the report.

D. NEW

This command represents a new page for multiple page reports. There are no additional fields after the command name.

In a preferred embodiment of the invention, a predetermined time interval is stored in memory 14. The microprocessor 10 may be configured so that the predetermined time interval is loaded into the microprocessor 10 internal timer. Based on a signal provided by real-time clock 22, when the predetermined time period has elapsed, the microprocessor 10 internal timer will trigger an interrupt signal and cause the microprocessor to generate a report.

FIGS. 2–5 illustrate the steps for generating a report. The process begins with opening a report template file 16 (step 102). At step 104, the microprocessor 10 reads a character string stored in the report template file 16. In decision 106, if the character string is a string termination character, the microprocessor 10 will cause the envelope feeder 18 to feed an envelope and printer 12 will feed the report to the inserter 20 which will insert the report into the envelope for mailing (step 108).

If in decision 110 the character string is a TEXT command, then the microprocessor 10 reads the first field of the TEXT command to determine whether the text in the second field has any of the three special font selections for the printing of the text. In decision 112, if the first field has the letter "b", the microprocessor sets BOLD_FLAG=true (step 114) in order to send a print bold character signal to printer 12. In decision 120, if the first field has the letter "i", the microprocessor sets ITALIC_FLAG=true (step 122) in order to send a print italics character signal to printer 12. In decision 126, if the first field has the letter "u", the microprocessor sets UNDER_FLAG=true (step 128) in order to send a print underline signal to printer 12. Finally, in step 134, the printer 12 prints the text which appears in the second field of the TEXT command. The program then returns to step 104 and reads the next character string.

If in decision 116 the character string is a MOVE command, then the microprocessor 10 reads the first field representing the x-coordinate (step 202) and the second field representing the y-coordinate (step 204). If in decision 206 the x and y-coordinates are valid, both coordinates are used to position the cursor of the printer 12. If an error, or a non-number is encountered, an error message will be printed in the report (step 210). The program then returns to step 104 and reads the next character string.

If in decision 118 the character string is a DATA command, the microprocessor 10 identifies the field which has the acronym for the requested data (step 306, 310, 314, 318, 322, 326, 330, 334, 338, 342, 346, or 350). The microprocessor 10 will then upload the data from memory 14 (step 304, 308, 312, 316, 320, 324, 328, 332, 336, 340, 344, or 348) and print the data (step 354) in the report. If, however, the microprocessor 10 identifies an acronym in the DATA field which is not supported by the software, the program reads the next character string (step 352). The program then returns to step 104 and reads the next character string.

If in decision 124 the character string is a NEW command, the microprocessor 10 prompts the printer 12 to begin a new page.

If the character string is not a TEXT, MOVE, DATA, or NEW command, the-report template file 16 contains an invalid command (step 132) and the program returns to step 104 and reads the next character string.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. A system for generating a report to be mailed, wherein said report is indicative of the maintenance status and configuration of the system, the system comprising:

(a) a printer;

(b) memory means for storing system data;

(c) a plurality of report templates;

(d) means for selecting one of the plurality of report templates, the report template containing predetermined control commands for controlling output to the printer;

(e) means for retrieving system data from the memory means;

(f) a microprocessor connected to the printer, the memory means, the selecting means, and the retrieving means, the microprocessor being programmed to:

(i) read a control command stored in the report template;

(ii) perform an operation indicated by the control command;

(iii) cause the printer to print a report, the report reflecting information defined by the report template and stored in the memory means;

(g) means for inserting the report into an envelope; and (h) means for placing a delivery address on the envelope.

2. The system of claim 1 further comprising real-time clock means operatively connected to the microprocessor for providing a time signal to the microprocessor, wherein the microprocessor is further programmed to:

(a) receive the current time;

(b) compare the current time with a predetermined time stored in the memory means;

(c) automatically print a report if the current time equals the predetermined time.

3. The system of claim 2 wherein the report contains system data regarding a usage of at least one subsystem.

4. The system of claim 3 wherein the subsystem is a document feeder.

5. The system of claim 4 wherein the document feeder is an envelope feeder.

6. The system of claim 3 wherein the subsystem is a moistener.

7. The system of claim 3 wherein the subsystem is a printer.

8. The system of claim 7 wherein the printer is an envelope printer.

9. The system of claim 2 wherein the report contains system data regarding means for identifying the system's configuration.

10. A system for acknowledging a software version installed in the system, wherein said acknowledgment is indicative of the maintenance status and configuration of the system, the system comprising:

(a) a printer;

(b) memory means for storing system data;

(c) means for selecting a confirmation report template;

(d) means for retrieving system data from the memory means;

(e) real-time clock means;

(f) display means;

(g) a microprocessor connected to the printer, memory means, selecting means, retrieving means, display means, and real-time clock means, the microprocessor being programmed to:

(i) cause the display means to display to display a current date and time;

(ii) request confirmation of the current date and time by a user of the system;

(iii) retrieve software version information from the memory means;

(iv) retrieve system identification information from the memory means;

(v) cause the printer to print the confirmation report, the report reflecting the system identification information and the software version information;

(h) means for inserting the report into an envelope; and (i) means for placing a delivery address on the envelope.

11. The system of claim 10 wherein the microprocessor causes the display means to display a message requesting the user to mail the envelope.

12. A method for generating reports for mailing, the method comprising the steps of:

(a) storing system data in a memory device;

(b) selecting a report template;

(c) retrieving the report template;

(d) retrieving system data from the memory device;

(e) printing a report corresponding to the report template;

(f) inserting the report into an envelope;

(g) placing a delivery address on the envelope;

(h) automatically generating a report after a predetermined time period has elapsed.

13. A method for acknowledging a software version installed in a system, the method comprising the steps of:

(a) storing system data in a memory device;

(b) selecting a confirmation report template;

(c) retrieving the confirmation report template;

(d) retrieving system data from the memory device;

(e) displaying a current date and time;

(f) confirming the current date and time;

(g) retrieving software version information from the memory device;

(h) retrieving system identification information from the memory device;

(i) printing a report corresponding to the confirmation report template;

(j) inserting the report into an envelope;

(k) placing a delivery address on the envelope.

14. The method of claim 13, further comprising the step of displaying a message requesting a user to mail the envelope.

* * * * *